United States Patent [19]

Arikawa

[11] 4,267,543

[45] May 12, 1981

[54] MINIATURE ELECTRIC FUSE

[75] Inventor: Hiroo Arikawa, Tokyo, Japan

[73] Assignee: San-O Industrial Co., Ltd., Tokyo, Japan

[21] Appl. No.: 93,378

[22] Filed: Nov. 13, 1979

[51] Int. Cl.[3] ..... H01H 85/48

[52] U.S. Cl. ..... 337/255; 337/198; 337/260

[58] Field of Search ..... 337/190, 187, 198, 260, 337/270, 290, 255

[56] References Cited

U.S. PATENT DOCUMENTS

| | | | |
|---|---|---|---|
| 2,383,484 | 8/1945 | Holmes | 337/260 |
| 3,110,787 | 11/1963 | Borzoni | 337/260 |
| 3,227,841 | 1/1966 | Gaia | 337/255 |
| 3,436,711 | 4/1969 | Borzoni | 337/198 |

*Primary Examiner*—William H. Beha, Jr.

[57] ABSTRACT

A miniature electric fuse having variable thermal capacity and improved arcing characteristic comprising a fuse base and body, a fuse cover and a pair of electrically conductive terminals protruding from the fuse base and partially embedded into the fuse body. The fuse body comprises a pair of opposed, spaced apart generally crescent-shaped members, each member being defined by an outer curved surface, generally flat top and bottom surfaces and a generally perpendicular inner wall, wherein each of said inner walls is spaced apart and is in parallel facing relation to one another. The embedded ends of the electrically conductive terminals are disposed midway in each of the respective members of the fuse body. A groove is cut in each of said members from their top surfaces to midway in said members and thereafter angled horizontally relative to the inner walls of said members. A fusible element is stretched between said terminals and has its end portions resting on the bottom of said grooves and are soldered thereto. A metal plate which may vary in thickness is placed upon the solder in intimate contact therewith for improved thermal capacity.

6 Claims, 6 Drawing Figures

MINIATURE ELECTRIC FUSE

BACKGROUND OF INVENTION

Quick acting miniature electric fuses have been widely used in various electric and electronic circuits. In most of these fuses, the fusible element is either soldered to the ends of the lead wires or it is simply secured thereto mechanically.

One type of miniature fuse is described in U.S. Pat. No. 3,227,841, issued to Aldens J. Gaia on Jan. 4, 1966. This fuse comprises a hollow housing made of an insulating material such as a refractory material, an electrically non-conductive disc also made of a refractory material and mounted in said housing and a pair of electrically conductive terminals extending through a pair of spaced openings in said disc mounting. The two terminals are partially enclosed in the housing and a fusible conductor stretches between the enclosed ends of said terminals and is soldered thereto at both ends.

Another type of fuse comprises a housing which includes a base made of an insulating material and a pair of lead wires passed through the base partially into the housing. Each tip of the lead wires is bent and a fusible conductor stretches between these tips with the ends of the fusible elements secured to the respective tips of the lead wires by means of an electrically conductive paste.

These prior fuses, however, are extremely unstable since the length of the fusible element is subject to variations, and evaporation of the electrodes due to arcing heat tends to prolong the arcing time. Accordingly, these fuses have not been entirely satisfactory.

In another type of fuse which is described in British Pat. No. 969,654, published on Sept. 16, 1964, the fuse comprises an integral fuse body through which extends a pair of spaced lead wires projecting beyond opposite ends of the fuse body, and a fusible element between the two ends of the lead wires in the fuse body. The fusible element and the lead wires are wholly embedded in a solid, arc-quenching filler made of epoxy resin and an imperforate cup-shaped cap is fitted over the fuse body to encase the fusible element, the lead wire portions in the fuse body and the epoxy resin filler.

The difficulty with fuses using epoxy fillers, however, is that, the heat generated by the passage of electric current causes thermal expansion with subsequent contraction when current flow is interrupted. Repeated thermal expansions and contractions often cause breakdown of the fusible element.

Accordingly, it is an object of this invention to provide a miniature electric fuse which is substantially free from the aforesaid inherent drawbacks of the prior fuses.

It is a further object of this invention to provide a miniature electric fuse which is quick acting and has improved arc-extinguishing characteristic.

It is also an object of this invention to provide such a fuse which also exhibits improved stability and thermal capacity.

The foregoing and other objects of this invention will be described in detail in the ensuing description of the preferred embodiment of the invention taken in conjunction with the accompanying drawings.

SUMMARY OF INVENTION

In accordance with this invention a miniature electric fuse is provided which, due to its unique construction and arrangement of its component parts, exhibits improved thermal stability and capacity, and superior arc-quenching characteristic. The fuse comprises a fuse base and body, a fuse cover which is fitted onto the fuse body and base, and a pair of electrically conductive lead wires protruding from the fuse base and partially embedded into the fuse body. The fuse body comprises a pair of opposed, spaced apart, generally crescent-shaped members, each member being defined by an outwardly curved surface, generally flat top and bottom surfaces and generally perpendicular inner wall, wherein each of said inner walls is spaced apart and is in parallel facing relation to one another. The embedded ends of the electrically conductive lead wires are disposed midway in each of the respective members of the fuse body. A groove is cut in each of said members from the top surface thereof to approximately midway in each member and thereafter is angled horizontally relative to said perpendicular inner walls of said members. A fusible element is stretched between said terminals and has its end portions resting on the bottom of said grooves and are soldered thereto.

In order to improve the thermal capacity of the fuse, and to prevent thc solder from scattering about in the event of a fuse blowout, a metal plate (e.g., a brass plate) is placed on top of the solder surface and is preferably bonded thereto for added safety.

BRIEF DESCRIPTION OF THE DRAWINGS

In the drawings, wherein like reference numerals are employed to designate like parts.

DETAILED DESCRIPTION OF THE PREFERRED EMBODIMENT OF THE INVENTION

Figure 1:
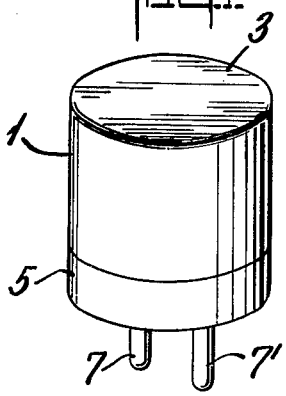
FIG. 1 is a perspective view of the fuse of this invention capped and ready for installation.
Figure 5:
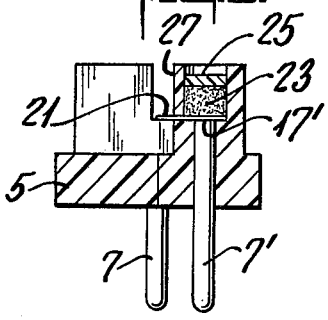
FIG. 5 is a sectional view taken along the like 5—5 in FIG. 4.
Figure 6:
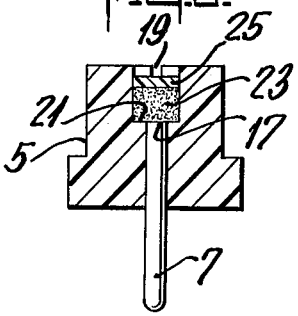
FIG. 6 is a sectional view taken along the line 6—6 of FIG. 4.

Referring first to FIG. 1, there is shown a miniature electric fuse generally designated as 1 comprising a fuse cap or cover 3 capped onto a fuse base 5, and a pair of electrodes 7,7' protruding from the fuse base 5. As shown in FIGS. 5 and 6 the electrodes 7,7' are embedded into the fuse base and body as will be more fully described hereinafter.

Figure 2:
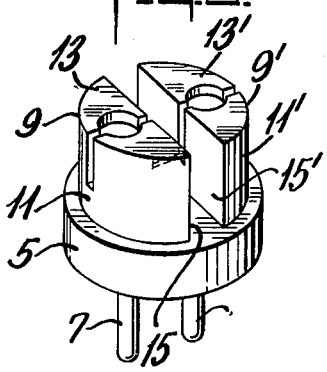
FIG. 2 is a perspective view of the fuse shown in FIG. 1 with the fuse cover removed.

With reference to FIG. 2, the fuse body comprises a pair of a generally crescent-shaped substantially identical, opposed, spaced apart members 9,9' which are defined by curved outer surfaces 11,11', relatively flat top surfaces 13,13' and bottom surfaces (not shown) and inner facing walls or surfaces 15,15' which are spaced apart and substantially parallel to one another. Each of the electrodes 7,7' extend through the respective members 13,13' terminating at 17,17' approximately midway therein as shown in FIGS. 5 and 6.

Figure 3:
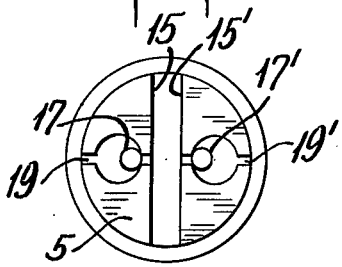
FIG. 3 is a plan view of the fuse shown in FIG. 2 before the fusible element is stretched between the electrodes.

As is further shown in FIGS. 2 and 3 each of the members 9,9' has a groove (19,19') cut therein from the top surface down to approximately the middle of each member and then at a right angle toward their respective inner walls 13,13'. A fusible element 21, e.g., an electrically conductive wire, is stretched between the terminals 17,17' of the electrodes 7,7' with the ends of the fusible elements positioned at the bottom of the respective grooves and are soldered to said electrodes as shown at 23.

Due to the unique construction of the miniature fuse of this invention and the layout of the fusible element in said grooves, there is less tendency to arcing when an overload current passes through the fuse, and whenever arcing occurs because of excessive current overload, it can be extinguished more rapidly.

Figure 4:
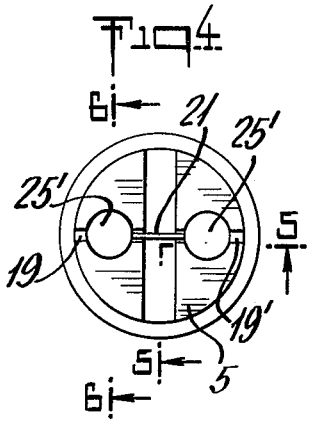
FIG. 4 is a view similar to FIG. 3 after the fusible element is stretched between the electrodes and soldered.

As is further shown in FIGS. 4 and 5, a relatively flat brass plate 25 of variable thickness is placed on the surface of the solder 23, in intimate contact therewith, and may, for example, be bonded thereto. The provision of the brass plate 25 (or any other equivalent plate) on the solder surface as aforesaid serves the dual function of imparting greater thermal capacity to the fuse so as to achieve quicker melting of the fusible element, and affords a safety factor in that it prevents the solder from spraying when the fuse blows due to passage of excessive electric current.

The lead wire portions in the fuse body, the solder material and the brass plates are completely encased within an insulated wall 27 which is a part of the fuse base.

Thus, in accordance with this invention, there is provided an improved quick acting fuse having superior performance characteristics than the hitherto employed fuses for similar applications. As it was previously mentioned the unique layout of the electrically conductive terminals 7,7' and the fusible element 21 substantially reduces arcing due to current overload through the fuse, and whenever arcing occurs due to the passage of excessive current, it can be extinguished more rapidly. Furthermore, the thermal capacity of the fuse may be increased or decreased by varying the thickness of the plate 25 which also serves to prevent the solder from scattering about in the event of a blowout.

While, the fuse of this invention has been described with a certain degree of particularity, it must be understood that such description is not intended to restrict or limit the scope of this invention. Several changes or modifications can be made in the construction of the fuse which are nevertheless comprehended from the detailed disclosure herein and which are therefore within the spirit and contemplation of this invention.

What is claimed is:

1. A miniature electric fuse comprising a fuse base and body, a fuse cover and a pair of electrically conductive lead wires protruding from said base and partially embedded into said fuse base and body, said fuse body comprising a pair of opposed, spaced apart, generally crescent-shaped members, each of said members being defined by an outwardly curved surface, generally flat top and bottom surfaces and a generally perpendicular inner walls, wherein said inner walls are spaced apart and in facing relation to one another, and wherein each of said electrically conductive lead wires protrude from said base and is partially embedded in one of said crescent-shaped members, a groove cut perpendicularly from the top surfaces of each of said crescent-shaped members a finite distance therein corresponding to the ends of said electrically conductive lead wires and thereafter horizontally in said crescent-shaped member in perpendicular relation to said inner walls, a fusible element stretched between said ends of said electrically conductive lead wires, said fusible element being securely positioned on the bottom of said groove and soldered thereto.

2. A fuse as in claim 1 wherein each of said electrically conductive lead wires extends approximately midway into its respective crescent-shaped member and wherein each of said grooves is cut to approximately midway of said crescent-shaped member before angling relative to said inner walls.

3. A fuse as in claim 1 further including a metal plate securely positioned on the surface of the solder.

4. A fuse as in claim 3 wherein said plate is made of brass.

5. A fuse as in claim 2 further including a metal plate securely positioned on the surface of the solder.

6. A fuse as in claim 5 wherein said plate is made of brass.

* * * * *